US005078087A

United States Patent [19]

Hogestyn

[11] Patent Number: 5,078,087

[45] Date of Patent: Jan. 7, 1992

[54] DEVELOPMENT APPARATUS

[75] Inventor: Larry G. Hogestyn, Ontario, N.Y.

[73] Assignee: Xerox Corporation, Stamford, Conn.

[21] Appl. No.: 667,921

[22] Filed: Mar. 11, 1991

[51] Int. Cl.[5] ..... G03G 15/09

[52] U.S. Cl. ..... 118/657; 118/658; 355/251; 355/328

[58] Field of Search ..... 355/326, 328, 251; 118/657, 358; 430/122

[56] References Cited

U.S. PATENT DOCUMENTS

| | | | |
|---|---|---|---|
| 4,833,505 | 5/1989 | Furuya et al. | 355/326 |
| 4,894,685 | 1/1990 | Shaji | 355/246 |
| 4,908,291 | 3/1990 | Fuma et al. | 430/122 |
| 5,009,973 | 4/1991 | Yoshida et al. | 430/122 X |

*Primary Examiner*—R. L. Moses

*Attorney, Agent, or Firm*—H. Fleischer; J. E. Beck; R. Zibelli

[57] ABSTRACT

An electrophotographic printing machine in which an electrostatic latent image is recorded on a photoconductive surface. One portion of the latent image is a discharged area with the other portion of the latent image being a charged area. The discharged image area is developed with toner particles of a first color and polarity by a first developer unit. No greater than 2% by volume of these toner particles have a diameter greater than about 20 microns. The first developer unit generates a weak magnetic field in the development zone and a strong magnetic field at the entrance and exit of the development zone. A second developer unit develops the charged image area with toner of a second color and polarity. The colors of the toners are different from one another.

15 Claims, 4 Drawing Sheets

DEVELOPMENT APPARATUS

This invention relates generally to an electrophotographic printing machine adapted to produce highlight color copies, and more particularly concerns a development system having at least two developer units with one of the developer units having a reduced volume of coarse toner particles.

The features of the present invention may be used in the printing arts and, more particularly in electrophotographic printing. In the process of electrophotographic printing, a photoconductive surface is charged to a substantially uniform potential. The photoconductive surface is image wise exposed to record an electrostatic latent image corresponding to the informational areas of an original document being reproduced. This records an electrostatic latent image on the photoconductive surface corresponding to the informational areas contained within the original document. Thereafter, a developer material is transported into contact with the electrostatic latent image. Toner particles are attracted from the carrier granules of the developer material onto the latent image. The resultant toner powder image is then transferred from the photoconductive surface to a copy sheet and permanently affixed thereto. The foregoing generally describes a typical mono-color electrophotographic copying machine.

Recently, electrophotographic printing machines have been developed which produce highlight color copies. A typical highlight color printing machine records successive electrostatic latent images on the photoconductive surface. When combined, these electrostatic latent images form a total latent image corresponding to the entire original document being reproduced. One latent image is usually developed with black toner particles. The other latent image is developed with color highlighting toner particles, e.g. red toner particles. These developed toner images are transferred sequentially to the copy sheet to form the color highlighted copy. A color highlight printing machine of this type is a two pass machine. Single pass highlight color printing machines using tri-level printing have also been developed. Tri-level electrophotographic printing is described in detail in U.S. Pat. No. 4,078,929. As described in this patent, the latent image is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development system is biased to about the background voltage. Such biasing results in a developed image of improved color sharpness.

In tri-level electrophotographic printing, the charge on the photoconductive surface is divided in three, rather than two, ways as is the case in mono-color printing. The photoconductive surface is charged, typically to about 900 volts. It is exposed image wise, such that one image corresponding to charged image areas remains at the full potential of 900 volts. The other image, which corresponds to discharged image areas is exposed to discharge the photoconductive surface to its residual potential of typically about 100 volts. The background areas are exposed to reduce the photoconductive surface potential to about halfway between the charged and discharged potentials, (typically about 500 volts). The developer unit arranged to develop the charged image areas, is typically biased to about 600 volts, and the developer unit, arranged to develop the discharged image areas, is biased to about 400 volts. The single pass nature of this system dictates that the electrostatic latent image pass through the developer units in a serial fashion. The latent image has a high charged image potential region and a low charge image potential region. The first developer unit is arranged to develop the discharged image areas and the second developer unit the charged image areas. Under these circumstances, the developed discharged image areas pass through the second developer unit. The developer rolls of the second developer unit have a tangential velocity significantly greater than the linear velocity of the photoconductive surface. The resulting abrasion forces tend to move toner particles toward the lead edge of the image resulting in blurry lines and solid area edges. It has been found that high concentrations of excessively large toner particles are pushed out of the image resulting in image blurriness. It is believed that these large particles pushed out of the image because, in theory, they are not attracted as strongly to the photoconductive surface as are smaller particles. In addition, large particles protrude above the smaller particles facilitating their movement by the developer rollers of the second developer unit away from the image.

Various techniques have hereinbefore been used to develop electrostatic latent images as illustrated by the following disclosures, which may be relevant to certain aspects of the present invention:

U.S. Pat. No. 4,833,505
Patentee: Furuya et al.
Issued: May 23, 1989

U.S. Pat. No. 4,894,685
Patentee: Shoji
Issued: Jan. 16, 1990

U.S. Pat. No. 4,908,291
Patentee: Fuma et al.
Issued: Mar. 13, 1990

Co-pending U.S. patent application Ser. No. 07/604,269
Applicant: Hogestyn
Filed: Oct. 29, 1990

The relevant portions of the foregoing patents may be briefly summarized as follows:

U.S. Pat. No. 4,833,505 discloses a first developer unit and a second developer unit. The second developer unit includes a toner and a magnetic carrier having a density of less than 4.0 grams/centimeter$^3$ and particle size ranging between 30 and 50 microns. The preferred density ranges between 1.7 grams/centimeter$^3$ and 4.0 grams/centimeter$^3$.

U.S. Pat. No. 4,894,685 describes a developer unit which uses toner and carrier particles having a diameter of less than 50 micrometers, preferably ranging from 1 to 15 micrometers. The carrier particles have a weighted-average diameter ranging from 5 to 40 micrometers.

The weight ratio of the toner to developer ranges from 2 to 30%.

U.S. Pat. No. 4,908,291 discloses a developer roll having toner particles with a diameter less than 15 micrometers. The carrier particles have a diameter ranging between 5 and 50 micrometers. The toner and carrier particles mixed in proportions wherein the total surface area of the toner and carrier are equal to each other.

Co-pending U.S. patent application Ser. No. 07/604,269 describes an electrophotographic printing machine in which an electrostatic latent image is recorded on a photoconductive surface. One portion of the latent image is a discharged area with the other portion of the latent image being a charged area. The discharged image area is developed with toner particles of a first color and polarity by a first developer unit. The first developer unit generates a weak magnetic field in the development zone and a strong magnetic field at the entrance and exit of the development zone. A second developer unit develops the charged image area with toner of a second color and polarity. The colors of the toners are different from one another.

In accordance with one aspect of the present invention, there is provided a printing machine of the type having a latent image recorded on a moving charge retentive surface. The improvement includes first means for developing, in a first development zone, a first portion of the latent image with toner particles of a first polarity. The first developing means has a distribution of toner particles wherein no greater than 2% by volume in coarse toner particles. Second means are provided for developing, in a second development zone, a second portion of the latent image with toner particles of a second polarity, opposite to the first polarity. The second developing means is positioned after the first developing means in the direction of movement of the charge retentive surface.

Pursuant to another aspect of the present invention, there is provided an electrophotographic printing machine of the type having an electrostatic latent image recorded on a moving photoconductive member. The improvement includes first means for developing, in a first development zone, a first portion of the latent image with toner particles of a first polarity. The first developing means has a distribution of toner particles wherein no greater than 2% by volume of the toner particles have a diameter greater than about 20 microns. Second means are provided for developing, in a second development zone, a second portion of the latent image with toner particles of a second polarity, opposite to the first polarity. The second developing means is positioned after the first developing means in the direction of movement of the photoconductive member.

Other features of the present invention will become apparent as the following description proceeds and upon reference to the drawings, in which.

Figure 6:
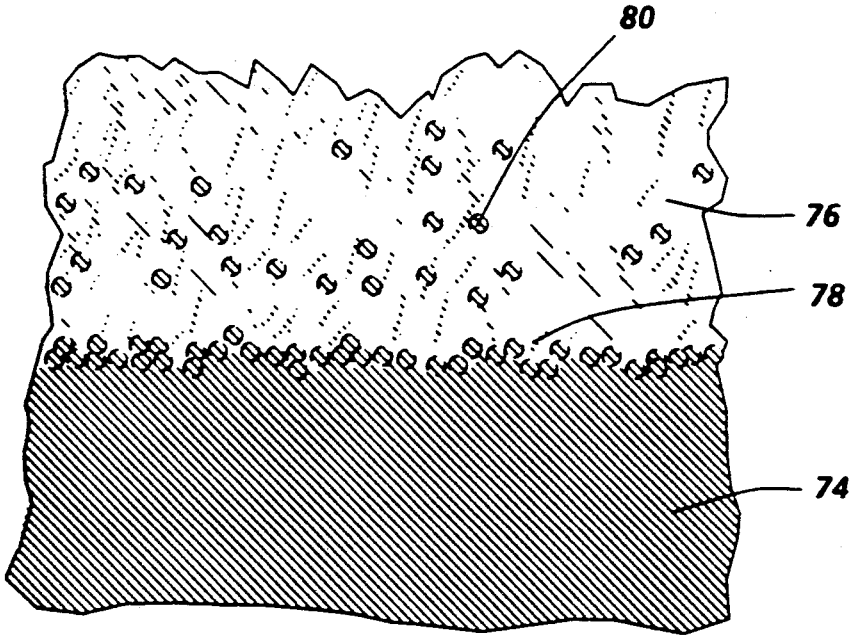
Figure 7:
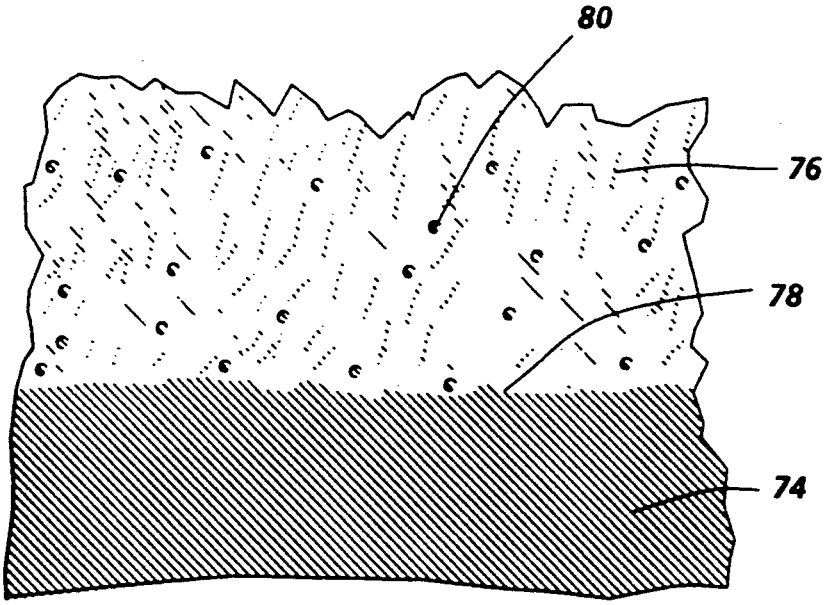

FIG. 6 is a schematic illustration showing an enlarged, elevational view of the lead edges of a large solid area with no reduction in coarse toner particles; and FIG. 7 is a schematic illustration showing an enlarged, elevational view of the lead edges of a large solid area with a reduction in coarse toner particles While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
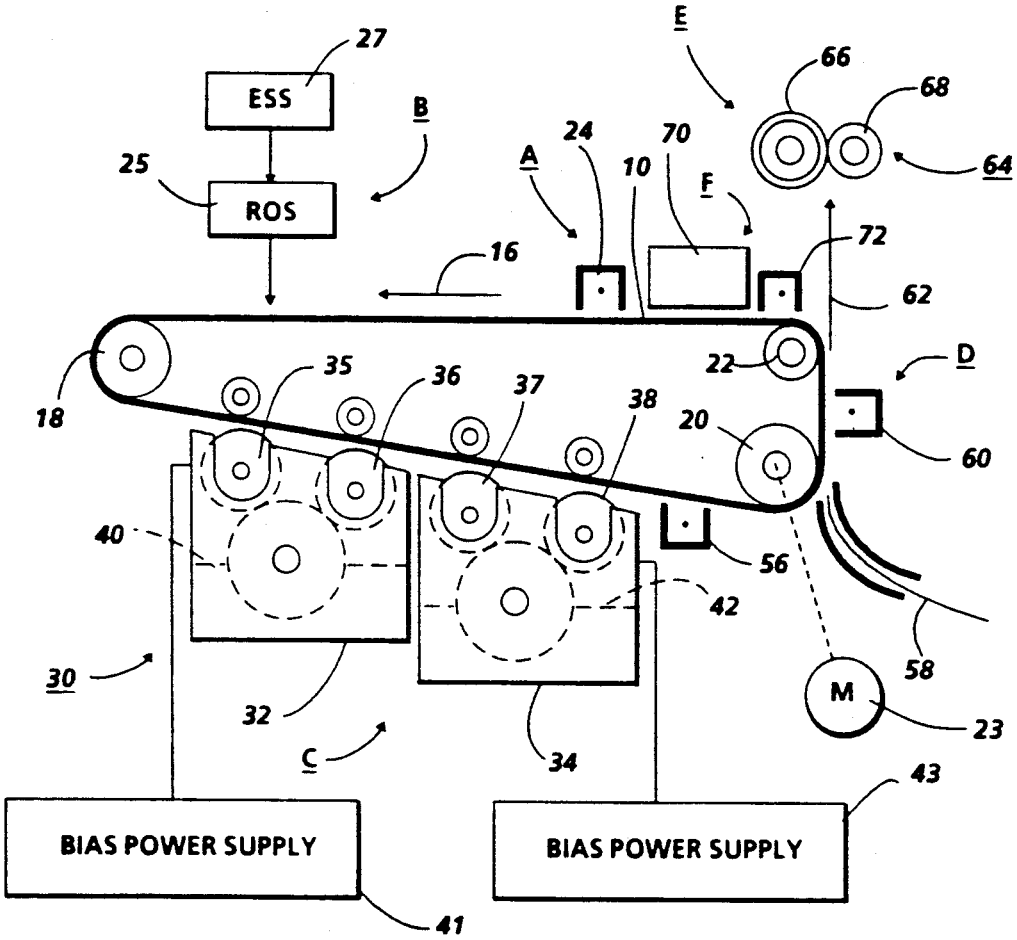
FIG. 1 is a schematic elevational view of an illustrative electrophotographic printing machine incorporating the developer units of the present invention therein.

For a general understanding of the illustrative electrophotographic printing machine incorporating the features of the present invention therein, reference is made to the drawings. In the drawings, like reference numerals have been used throughout to designate identical elements. FIG. 1 schematically depicts the various components of an electrophotographic printing machine incorporating the developer units of the present invention therein. Although the developer units of the present invention are particularly well adapted for use in the illustrative printing machine, it will become evident that these developer units are equally well suited for use in a wide variety of printing machines and are not necessarily limited in their application to the particular embodiments shown herein.

Referring now to FIG. 1, the electrophotographic printing machine employs a belt 10, i.e. a charge retentive member, having a photoconductive surface deposited on a conductive substrate. Preferably, the photoconductive surface is made from a selenium alloy with the conductive substrate being made preferably from an electrically grounded aluminum alloy. Belt 10 moves in the direction of arrow 16 to advance successive portions thereof sequentially through the various processing stations disposed about the path of movement thereof. Belt 10 is entrained about tensioning roller 18, drive roller 20, and stripping roller 22. Motor 23 rotates roller 20 to advance belt 10 in the direction of arrow 16. Roller 20 is coupled to motor 23 by suitable means such as a belt drive.

Initially, successive portions of belt 10 pass through charging station A. At charging station A, a corona discharge device, such as a scorotron, corotron or dicorotron indicated generally by the reference numeral 24, charges the belt 10 to a selectively high uniform positive or negative potential. Preferably charging is negative. Any suitable control, well known in the art, may be employed for controlling the corona discharge device 24.

Next, the charged portions of the photoconductive surface are advanced through exposure station B. At exposure station B, the uniformly charged photoconductive surface or charge retentive surface is exposed to a laser based input and/or output scanning device 25 which causes the charge retentive surface to be discharged in accordance with the output from the scanning device. Preferably the scanning device is a three level laser Raster Output Scanner (ROS). An electronic sub system (ESS) 27 provides the control electronics which prepare the image data flow between the data source and the ROS 25. Alternatively, the ROS and ESS may be replaced by a conventional light/lens exposure device. The photoconductive surface, which is initially charged to a high charge potential, is discharged image wise in the background (white) image areas and to near zero or ground potential in the highlight (i.e. color other than black) color parts of the image.

At development station C, a magnetic brush development system, indicated generally by the reference numeral 30 advances developer materials into contact with the electrostatic latent images. The development system 30 comprises first and second developer units 32 and 34. Preferably, each magnetic brush developer units includes a pair of magnetic brush developer rollers mounted in a housing. Thus, developer unit 32 contains a pair of rollers 35, 36 with developer unit 34 containing a pair of magnetic brush rollers 37, 38. Each pair of rollers advances its respective developer material into contact with the latent image. Appropriate developer biasing is accomplished via power supplies 41 and 43 electrically connected to respective developer units 32 and 34.

Color discrimination in the development of the electrostatic latent image is achieved by moving the latent image recorded on the photoconductive surface past two developer units 32 and 34 in a single pass with the magnetic brush rolls 35, 36, 37 and 38 electrically biased to voltages which are offset from the background voltage, the direction of offset depending on the polarity of toner in the housing. The first developer unit 32, in the direction of movement of belt 10 as indicated by arrow 16, develops the discharged image areas of the photoconductive surface. This developer unit contains red developer material 40 having triboelectric properties such that the red toner is driven to the discharged image areas of the latent image by the electrostatic field between the photoconductive surface and the electrically biased developer rolls. Conversely, the second developer unit 34, in the direction of movement of belt 10 as indicated by arrow 16, develops the highly charged image areas of the latent image. This developer unit contains black developer material 42 having a triboelectric charge such that the black toner is urged towards highly charged areas of the latent image by the electrostatic field existing between the photoconductive surface and the electrically biased developer rolls in the second developer unit.

By way of example, the carrier in developer unit 32 consists of 100 to 150 micron Hoeganese steel core coated (by weight) with 1.2% a methyl terpolymer with 20%, by weight of carbon black dispersed therein. The toner is made up (by weight) of 85% PLIOLITE (Trademark of Goodyear Tire and Rubber Company), 13.4% of a master batch of 1:1 litho scarlet pigment-/negative charging styrene n-butyl methacralate polymer, 0.56% magenta and hostaperm pink pigments predispersed in polymer, 1% dimethyl di-stearyl ammonium methyl sulfate, 0.5% aerosil, and 0.1% zinc stearate. When this developer is mixed to a 2.5% (by weight) toner concentration and rolled milled for 10 minutes, the toner's tribo, as measure by placing the developer in a screened faraday cage and removing the toner with an air stream, is a negative 11 microcoulombs/gram. The red toner is filtered to reduce the coarse end of the particle size distribution. The coarse toner particle content, i.e. toner particles having a diameter greater than 20 microns in diameter, does not exceed 2% by volume of the toner particles. The median diameter of the toner particles is 13 microns.

The black carrier in developer unit 34 consists of 100 to 150 micron Hoeganese steel core coated (by weight) with 0.4% of a positive charging co-polymer (chlorotrifloro-ethylene+polyvinyl chloride) with 20%, by weight of VULCAN (Trademark of Cabot Corporation) carbon black dispersed therein. The composition of the black toner is 92% styrene n-butyl methacralate polymer, 6% carbon B REGAL 330 (Trademark of Cabot Corporation) carbon black, and 2% cetyl pyridinium chloride. The tribo of the black toner as determined by the roll mill and faraday cage method is a positive 20 micro-coulombs/gram. The entire voltage difference is shared equally between the highly charged image areas and the discharged image areas. This corresponds to approximately 800 volts (if a realistic charging level of 900 volts and a residual discharge voltage of 100 volts are assumed). Allowing an additional 100 volts for the cleaning fields in each development housing means an actual development contrast voltage for highly charged image areas of approximately 300 volts and an approximately equal amount for the discharged image areas. In the foregoing case, 300 volts of contrast voltage is provided by electrically biasing the first developer unit, which develops the discharged image areas with non-black, negatively charged toner, to a voltage level of approximately 400 volts and the second developer unit, which develops the highly charged image areas with positively charged black toner, to a voltage level of 600 volts.

A sheet of support material 58 is moved into contact with the toner image at transfer station D. The sheet of support material is advanced to transfer station D by a conventional sheet feeding apparatus, not shown. Preferably, the sheet feeding apparatus includes a feed roll contacting the uppermost sheet of a stack of copy sheets. Feed rolls rotate so as to advance the uppermost sheet from stack into a chute which directs the advancing sheet of support material into contact with the photoconductive surface of belt 10 in a timed sequence so that the toner powder image developed thereon contacts the advancing sheet of support material at transfer station D.

Because the composite image developed on the photoreceptor consists of both positive and negative toner, a negative pre-transfer corona discharge member 56 is provided to condition the toner for effective transfer to a sheet using positive corona discharge.

Transfer station D includes a corona generating device 60 which sprays ions of a suitable polarity onto the backside of sheet 58. This attracts substantially simultaneously the black and non-black portions of the toner powder image from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a pressure roller 68. Sheet 58 passes between fuser roller 66 and pressure roller 68 with the toner powder image contacting fuser roller 66. In this manner, the toner powder image is permanently affixed to sheet 58. After fusing, a chute. not shown, guides the advancing sheet 58 to a catch tray, also not shown, for subsequent removal from the printing machine by the operator.

After the sheet of support material is separated from photoconductive surface of belt 10, the residual toner particle carried by the non-image areas on the photoconductive surface are charged to a suitable polarity and level by a preclean charging device 72 to enable removal therefrom. These particles are removed at cleaning station F. The vacuum assisted, electrostatic, fur brush cleaner unit 70 is disposed at the cleaning station F. The cleaning unit has two fur brush rolls that rotate at relatively high speed which creates mechanical forces that tend to sweep the residual toner particles into an air stream (provided by a vacuum source), then into a cyclone separator, and finally into a waste bottle. In addition, the brushes are triboelectrically charged to a very high negative potential which enhances the attraction of the residual toner particles to the brushes and increases the cleaning performance.

Subsequent to cleaning, a discharge lamp (not shown) floods the photoconductive surface with light to dissipate any residual electrostatic charge remaining prior to the charging thereof for the successive imaging cycle.

Figure 2:
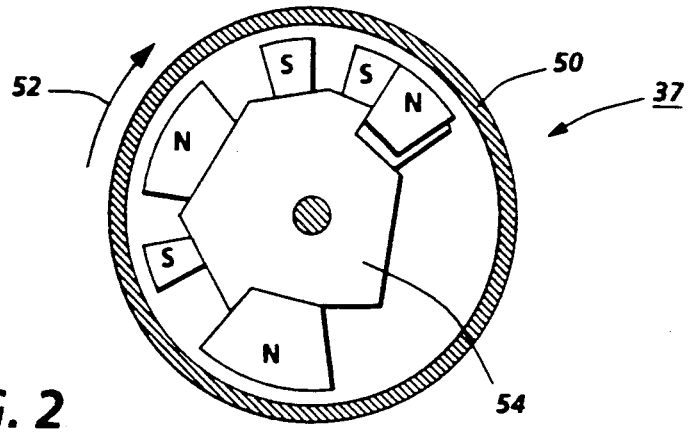
FIG. 2 is an elevational view showing one of the developer rollers used in the second developer unit of the FIG. 1 printing machine.
Figure 4:
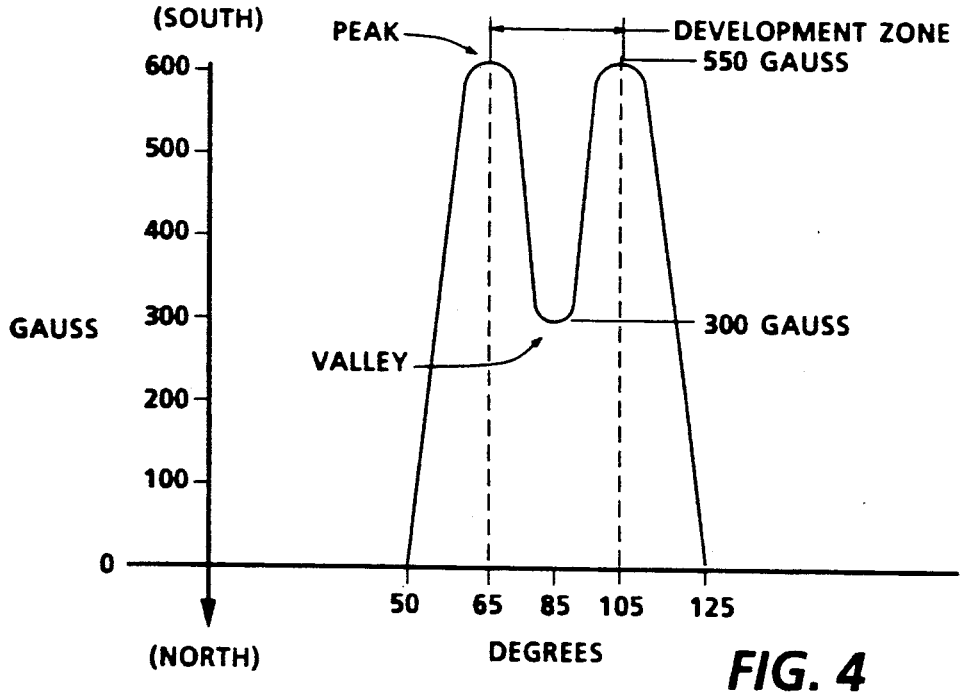
FIG. 4 is a graph depicting the magnetic field strength of the first developer unit in the development zone adjacent thereto.
Figure 5:
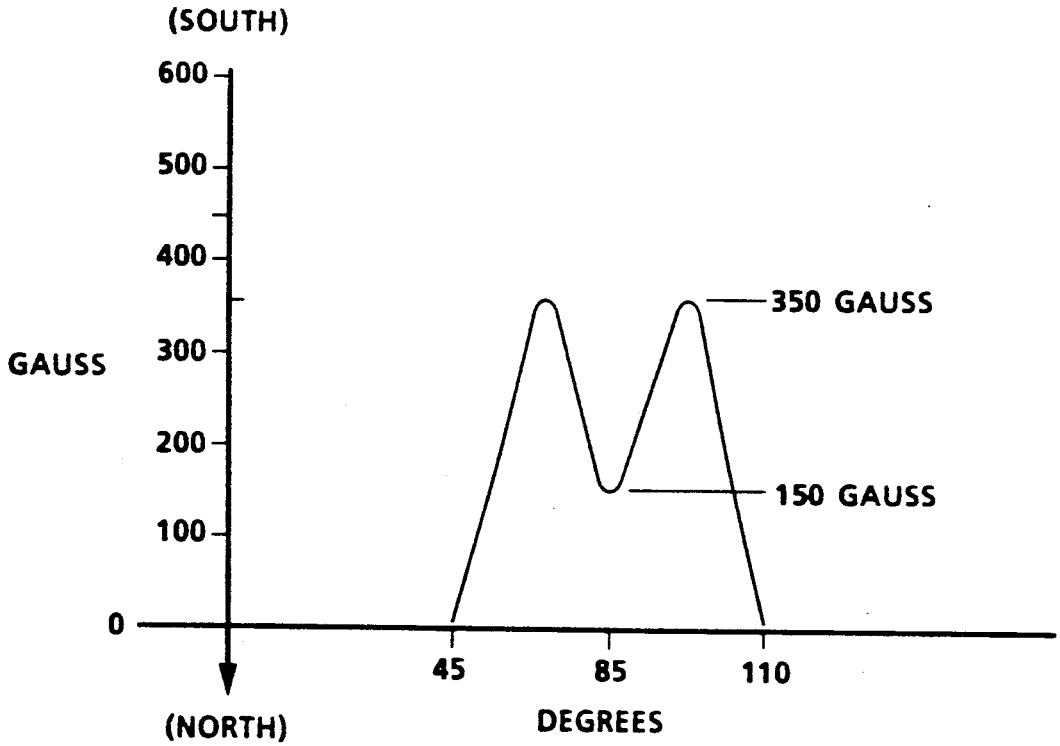
FIG. 5 is a graph depicting the magnetic field strength of the second developer unit in the development zone adjacent thereto.

Referring now to FIG. 2, there is shown developer roller 37 of developer unit 34 in greater detail. Developer rollers 37 and 38 are substantially identical to one another so only developer roller 37 will be described. Developer roller 37 advances the black developer material into contact with the electrostatic latent image recorded on the photoconductive surface of belt 10. As previously indicated, developer roller 37 is electrically biased so that the highly charged image areas of the latent image attract developer material thereto. Developer roller 37 includes a non-magnetic tubular member or sleeve 50 preferably made from aluminum having the exterior surface thereof roughened. Tubular member 50 rotates in the direction of arrow 52. A magnet assembly 54 is mounted interiorly of tubular member-50 and spaced therefrom. Magnet assembly 54 is stationary and positioned to attract the developer material to the exterior circumferential surface of tubular member 50. In this way, as tubular member 50 rotates in the direction of arrow 52, developer material is attracted to the exterior circumferential surface and moved therewith into the development zone. Magnet assembly 54 is positioned so that two small magnetic poles are located substantially in the center of the development zone. The magnetic poles on magnet 54 are located opposed from the photoconductive surface in the region of the gap between tubular member 50 and belt 10. In this way, a very weak magnetic field is generated in the development zone. Magnet assembly 54 has two small magnetic poles in the development zone which generates a magnetic field having a profile of the type shown in FIG. 5. The peak and valley gauss levels are 350 and 150 gauss, respectively. By way of comparison, the magnetic field generated by magnet assembly 48 in the development zone and shown in FIG. 4 has a peak and valley gauss of about 550 and 300, respectively.

Figure 3:
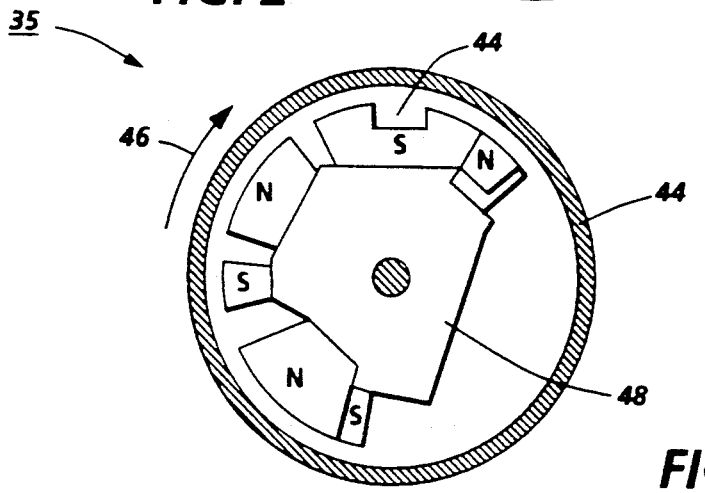
FIG. 3 is an elevational view showing one of the developer rollers used in the first developer unit of the FIG. 1 printing machine.

FIG. 3 depicts developer roller 35 of developer unit 32 in greater detail. Developer rollers 35 and 36 are substantially identical to one another so only developer roller 35 will be described. Developer roller 35 advances the non-black developer material into contact with the electrostatic latent image recorded on the photoconductive surface of belt 10. As previously indicated, developer roller 35 is electrically biased so that the discharged image areas of the latent image attract developer material thereto. Developer roller 35 includes a non-magnetic tubular member or sleeve 44 preferably made from aluminum having the exterior surface thereof roughened. Tubular member 44 rotates in the direction of arrow 46. A magnet assembly 48 is mounted interiorly of tubular member 44 and spaced therefrom. Magnet assembly 48 is stationary and positioned to attract the developer material to the exterior circumferential surface of tubular member 44. In this way, as tubular member 44 rotates in the direction of arrow 46, developer material is attracted to the exterior circumferential surface and moved therewith into the development zone. Magnet assembly 48 is positioned so that a slot 47, which is machined on top of the development magnet and extends its full length, is located substantially in the center of the development zone. The slotted portion of the development pole on magnet assembly 48 is located opposed from the photoconductive surface in the region of the gap between tubular member 44 and belt 10. In this way, a weak magnetic field is generated in the central portion of the development zone. However, at the entrance and exit of the development zone, which is adjacent to both sides of the machined slot, the magnet material is much thicker. The thicker magnet material adjacent to the machined slot in the development zone generates strong magnetic fields at the entrance and exit of the development zone. Magnet assembly 48 generates a magnetic field having a profile of the type shown in FIG. 4. As shown thereat the magnetic field has a valley surrounded by twin peaks. The magnetic field generated in the central portion of the development zone is weak with the magnetic field generated at the entrance and exit regions of the development zone being strong, By way of example, the magnetic field generated by magnet 48 in the central portion of the development zone is illustrated by the valley and shown in the FIG. 4 graph. The minimum magnetic field in the valley is about 300 gauss. The maximum magnetic field at the peaks is about 550 gauss.

Turning now to FIGS. 6 and 7, there is shown a comparison between the usage of toner particles having a coarse particle content, i.e. toner particles having a diameter ranging between 20 and 30 microns, of 9% by volume (FIG. 6) to one having a reduced coarse toner particle of 2% by volume (FIG. 7). As shown in FIG. 6, reference numeral 74 designates the image area, i.e. a large solid area developed on a sheet, and reference numeral 76 designates a non-image area. The boundary between non-image area 76 and image area 74 is designated by the reference numeral 78. As shown in FIG. 6, the boundary is blurred or ragged due to the bleeding of coarse toner particles from the the image area 74 onto the non-image area 76 at boundary 78. In addition a large number of random coarse toner particles 80 are found scattered over the non-image area 76. The image area is developed with the red toner particles of developer unit 32. After development, the red toner image passes through developer unit 34. It is believed that the development rollers of developer unit 34 move some of the large, coarse toner particles from the image area to the non-image resulting in the ragged, blurry effect at the boundary and the scattering of coarse toner particles in the non-image area. After identifying the cause of this problem, the solution is to reduce the coarse end of the toner particle size distribution. Thus, the coarse toner particle content of developer unit 32 was reduced from 9% by volume to 2% by volume. The results of this reduction in coarse toner particles is shown in FIG. 7. As depicted thereat, the boundary 78 between the image area 74 and the non-image area 76 is much sharper than that of FIG. 6. In addition, the number of coarse particles 80 in the non-image area 76 is less than the number shown in FIG. 6. Hence, it is clear that when the coarse end of the particle size distribution is reduced from 9% to 2% by volume, the large particle drag out is significantly reduced and print quality greatly enhanced.

In recapitulation, the latent image recorded on the photoconductive surface has charged image areas and discharged image areas. The first developer unit, in the direction of movement of the photoconductive surface, develops the discharged image areas of the latent image with non-black toner. The coarse end of the toner particle distribution, i.e. toner particles having a diameter of at least 20 microns, is no greater than 2% by volume. The second developer unit, positioned after the first developer unit, develops the charged image areas of the latent image with black toner. The non-black toner image and the black toner image are transferred substantially simultaneously from the photoconductive surface forming a color highlight print.

It is, therefore, apparent that there has been provided in accordance with the present invention, a developer unit for use in an electrophotographic printing machine that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications, and variations that fall within the spirit and broad scope of the appended claims.

I claim:

1. A printing machine of the type having a latent image recorded on a moving charge retentive surface, wherein the improvement includes:

first means for developing, in a first development zone, a first portion of the latent image with toner particles of a first polarity, said first developing means having a distribution of toner particles wherein no greater than 2% by volume is coarse toner particles; and second means for developing, in a second development zone, a second portion of the latent image with toner particles of a second polarity, opposite to the first polarity, said second developing means being positioned after said first developing means in the direction of movement of the charge retentive surface.

2. A printing machine according to claim 1, wherein the coarse toner particles have a diameter of at least 20 microns.

3. A printing machine according to claim 2, wherein the median diameter of the toner particles of said first developing means is about 13 microns.

4. A printing machine according to claim 3, wherein said first developing means comprises first magnetic means generating a weak magnetic field in the first development zone and a strong magnetic field at the entrance and exit of the first development zone.

5. A printing machine according to claim 4, wherein:

the first portion of the latent image is a discharged area; and the second portion of the latent image is a charged area.

6. A printing machine according to claim 5, wherein said second means includes second magnetic means generating a weak magnetic field in the second development zone.

7. A printing machine according to claim 6, wherein:

said first developing means develops the first portion of the latent image with toner particles of a first color to form a first visible image; and said second developing means develops the second portion of the latent image with toner particles of a second color different from the first color to form a second visible image.

8. A printing machine according to claim 7, further including means for transferring the first visible image and the second visible image substantially simultaneously from the charge retentive surface to a sheet.

9. An electrophotographic printing machine of the type having an electrostatic latent image recorded on a moving photoconductive member, wherein the improvement includes:

first means for developing, in a first development zone, a first portion of the latent image with toner particles of a first polarity, said first developing means having a distribution of toner particles wherein no greater than 2% by volume of the toner particles have a diameter greater than about 20 microns; and second means for developing, in a second development zone, a second portion of the latent image with toner particles of a second polarity, opposite to the first polarity, said second developing means being positioned after said first developing means in the direction of movement of the photoconductive member.

10. A printing machine according to claim 9, wherein the median diameter of the toner particles of said first developing means is about 13 microns.

11. A printing machine according to claim 10, wherein said first developing means comprises first magnetic means generating a weak magnetic field in the first development zone and a strong magnetic field at the entrance and exit of the first development zone.

12. A printing machine according to claim 11, wherein:

the first portion of the latent image is a discharged area; and the second portion of the latent image is a charged area.

13. A printing machine according to claim 12, wherein said second means includes second magnetic means generating a weak magnetic field in the second development zone.

14. A printing machine according to claim 13, wherein:

said first developing means develops the first portion of the latent image with toner of a first color to form a first visible image; and said second developing means develops the second portion of the latent image with toner of a second color different from the first color to form a second visible image.

15. A printing machine according to claim 14, further including means for transferring the first visible image and the second visible image substantially simultaneously from the photoconductive member to a sheet.

* * * * *